United States Patent [19]

Rule

[11] 4,214,983

[45] Jul. 29, 1980

[54] RECOVERY OF COPPER FROM COPPER OXIDE MINERALS

[75] Inventor: William T. Rule, Hibbing, Minn.

[73] Assignee: The Hanna Mining Company, Cleveland, Ohio

[21] Appl. No.: 3,878

[22] Filed: Jan. 16, 1979

[51] Int. Cl.[2] ..... B03D 1/02

[52] U.S. Cl. ..... 209/166

[58] Field of Search ..... 209/166, 167; 252/61; 75/2

[56] References Cited

U.S. PATENT DOCUMENTS

| | | | |
|---|---|---|---|
| 3,438,494 | 4/1969 | Fuerstenau | 209/166 |
| 3,689,561 | 9/1972 | Lee | 252/61 X |
| 3,845,862 | 11/1974 | McGuire | 209/166 |
| 3,928,185 | 12/1975 | Petrovich | 209/160 |
| 4,022,686 | 5/1977 | Asakutsu | 209/166 |
| 4,130,415 | 12/1978 | Nagaraj | 209/166 X |

FOREIGN PATENT DOCUMENTS

| | | | |
|---|---|---|---|
| 381398 | 10/1973 | U.S.S.R. | 209/166 |

OTHER PUBLICATIONS

Gutzeit, Chelate Forming Compds. as Flot. Reagents, TAIME, vol. 169, pp. 272–286 (1946).

DeWitt et al., Chelate Compds. as Flot. Reagents, Dept. of Chem., Mich. College of Tech., May. 1939.

*Primary Examiner*—Robert Halper

*Attorney, Agent, or Firm*—Maky, Renner, Otto & Boisselle

[57] ABSTRACT

A method of recovering copper from ores containing copper as atacamite/paratacamite by froth flotation is described which comprises utilizing as a promoter collector compounds having the formula $$RC(OH)=N-O^{\ominus}H_2N^{\oplus}R^1R^2$$

wherein

R is an aliphatic group containing from about five to ten carbon atoms or an aromatic group containing from six to about ten carbon atoms, and $R^1$ and $R^2$ are each independently alkyl groups containing from one to five carbon atoms.

The method of the invention is useful in treating copper ores containing very small percentages by weight of copper.

11 Claims, 1 Drawing Figure

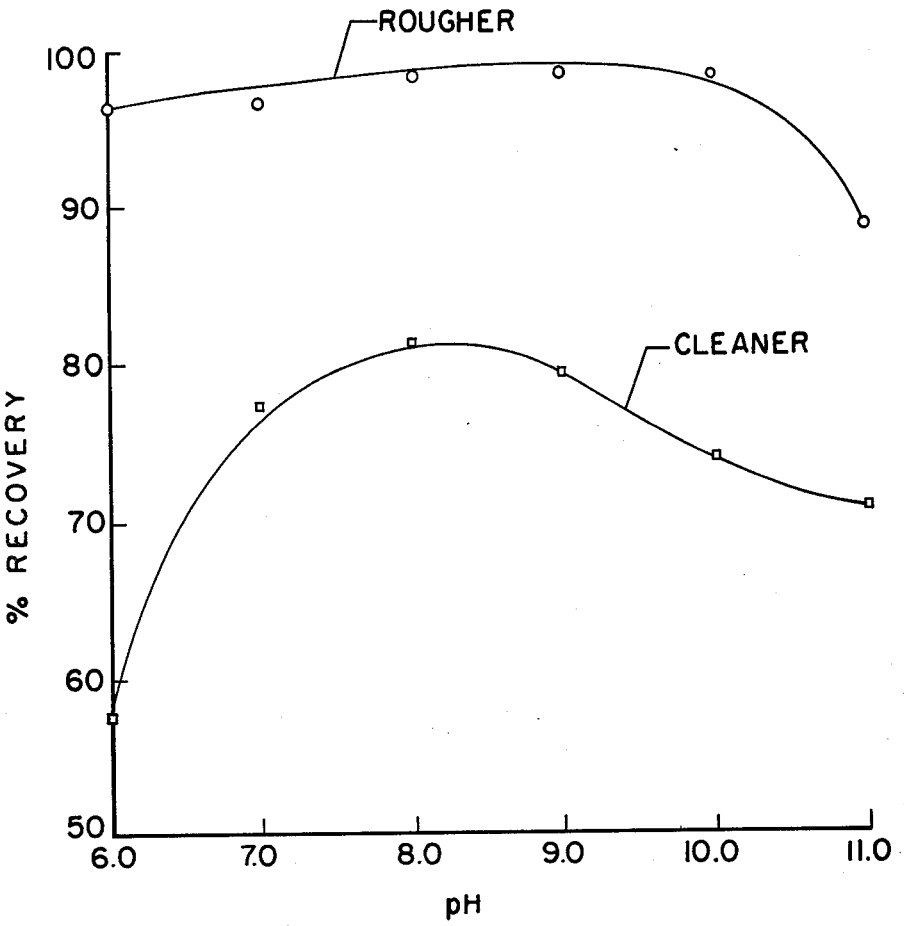
ROUGHER
CLEANER
100
90
80
70
60
50
% RECOVERY
6.0
7.0
8.0
9.0
10.0
11.0
pH

RECOVERY OF COPPER FROM COPPER OXIDE MINERALS

BACKGROUND OF THE INVENTION

This invention relates generally to a process of recovering copper from ores containing copper as oxides, and more particularly, the invention relates to a process for recovering copper from ores containing atacamite/-paratacamite utilizing a special promoter collector for the copper.

Copper minerals in the oxidized zone of porphyry copper deposits are categorized broadly as copper "oxides". These oxides include atacamite/paratacamite [$Cu_2(OH)_3Cl$], azurite/malachite [$CU_3(CO_3)_2(OH)_2$-/$CU_2(CO_3)(OH_2)$] chrysocolla [$CuSiO_3.nH_2O$], cuprite [$CU_2O$], etc. The copper minerals in the underlying sulfide rich and primary sulfide zones include chalcocite [$CU_2S$], chalcopyrite [$CuFeS_2$], and bornite [$CU_5FeS_4$].

One commonly used method for concentrating copper sulfide minerals utilizes a froth flotation circuit utilizing known sulfide collectors. However, the normally used collectors for sulfide minerals generally will not react upon the "oxide" copper minerals, and, hence, the recovery of copper from the copper oxide minerals often requires treatment steps which are different from those used with the sulfide ores. The recovery of chrysocolla and iron oxide minerals from their ores by flotation utilizing hydroxamic acids and salts such as potassium octylhydroxamate as chelating agents for the copper is described in U.S. Pat. No. 3,488,494.

SUMMARY OF THE DISCLOSURE

In accordance with the present invention, the recovery of copper from oxidized copper deposits containing atacamite/paratacamite is improved by utilizing a particular promoter collector when conditioning a slurry of copper ore. Compounds found useful in accordance with this invention have the formula $$RC(OH)=N-O^{\ominus}H_2N^{\oplus}R^1R^2$$

wherein

R is an aliphatic group containing from about five to ten carbon atoms or an aromatic group containing from six to about ten carbon atoms, and $R^1$ and $R^2$ are each independently alkyl groups containing from one to five carbon atoms.

BRIEF DESCRIPTION OF THE DRAWING

A drawing is attached which is a graph showing the influence on pH of the slurry on the copper recovery.

DESCRIPTION OF THE PREFERRED EMBODIMENTS

The froth flotation process of this invention for separating and recovering copper from ores containing copper as atacamite/paratacamite generally comprises frothing said ore in the presence of a small amount of the promoter collector, preferably in an aqueous medium having a pH within a range of from about 6 to about 10.

The copper-containing ores which are treated in accordance with the method of the invention are the ores broadly characterized as copper oxide ores, and more particularly, are ores wherein the copper is present principally as atacamite/paratacamite generally represented by the formula $Cu_2(OH)_3Cl$. Such ores generally are found in the oxidized zone of porphyry copper deposits. Two ore samples from Arizona which can be treated with the flotation method of the invention have been analyzed and the results of the analysis are reported below in Table 1.

TABLE I

| | % Weight Analysis | | | | |
|---|---|---|---|---|---|
| Ore Sample No | Total Copper | Oxide Copper | Sulfide Copper | Cl | S |
| 1 | 1.77 | 1.67 | 0.10 | 0.41 | 0.05 |
| 2 | 1.54 | 1.17 | 0.37 | 0.22 | 0.30 |

Approximately 80% of the copper in Ore Sample No. 1 occurs as atacamite/paratacamite. The balance of the copper mineralization in Ore Sample No. 1 is chrysocolla, cuprite, native copper, copper pitch, copper montmorillonite and various sulfides. Approximately 50% of the copper present in Ore Sample No. 2 is present as atacamite/paratacamite, the balance of the copper mineralization being in the form of chrysocolla, cuprite, native copper, copper montmorillonite, copper pitch and copper sulfides, principally chalcocite. The copper minerals in both ore samples represent a very small percentage by weight of the weight of the ore, and it is highly desirable therefore to concentrate these copper values in a small weight.

It has been found in accordance with the method of the invention that the flotation and recovery of copper from such ores is improved when a particular type of compound is used to condition the suspension prior to formation of the froth. These compounds which act as promoter collectors are represented by the formula $$RC(OH)=N-O^{\ominus}H_2N^{\oplus}R^1R^2 \qquad \text{(Formula I)}$$

wherein

R is an aliphatic group containing from about five to ten carbon atoms or an aromatic group containing from six to about ten carbon atoms, and $R^1$ and $R^2$ are each independently alkyl groups containing from one to five carbon atoms.

Compounds of this type are known as dialkyl ammonium salts of alkyl hydroxamic acids which also may be represented by the tautomeric formula $$R-C(O)-N(H)O^{\ominus}H_2N^{\oplus}R^1R^2 \qquad \text{(Formula Ia)}$$

However, for the purposes of this application and the claims, the hydroxamic salts will be represented by Formula I.

The preferred salts are the dimethyl ammonium salts. A preferred example of a salt utilized in the method of the invention is the dimethyl ammonium salt of a mixture of $C_7$–$C_9$ hydroxamic acids which is available from the Ashland Chemical Co., Columbus, OH.

The method of the invention which utilizes the above described promoter collectors for recovering copper from ores containing copper as atacamite/paratacamite comprises generally the steps of (a) preparing an aqueous slurry of the ore, (b) adjusting the pH of the slurry of the desired value (c) adding to the slurry a promoter collector represented by Formula I above, (d) adding a frothing agent to the slurry, (e) agitating the mixture to form a froth containing the copper, (f) removing the froth, and (g) recovering the floated copper from the froth.

The slurry which is prepared and used in the method of the invention is made up from an ore which has been comminuted by grinding in a grinding mill of any standard type where the ore is mixed with water and ground to the desired particle size. Generally, the grinding mill will contain forged steel balls to produce a preferred particle size of approximately 97% −100 mesh. Conditioning agents may be added to the grinding mill prior to the grinding of the crude ore. The amount of water contained in the grinding mill may be varied depending on the desired solid content of the slurry. Solids of contents of from about 60 to 70% are preferred in the grinding operation. The slurry obtained in this manner may be used directly or may be filtered and dried to ease handling. If filtered, the residue may be repulped with water in a flotation cell.

The pH of the aqueous slurry prepared in accordance with the above procedure preferably is maintained within the range of from about 6 to 10. A preferred range of pH for the aqueous slurry is from about 7.5 to 8.5.

After the pH of the slurry has been adjusted to the desired value, the promoter collector is added to the slurry. Relatively small amounts of the promoter collector, e.g., up to about 3.6 lbs per tone of ore, are effective in promoting the flotation and collection of the copper minerals, and these amounts can be readily determined by one skilled in the art. Generally, the total amount of promoter collector may be varied from as little as 0.1 to as much as about 2.5 lb. of agent per tone of ore. It generally is preferred to maintain the temperature of the slurry between about 20° and 70° C. After the promoter collector has been added to the slurry, the slurry is conditioned for up to about 30 minutes and one or more frothing agents are added as required to form a suitable froth.

The frothing agents generally are incorporated in amounts ranging from about 0.001 to about 0.2 lb. per ton of ore in the slurry. Pine oil, cresylic acid, various alcohols such as amyl alcohol and methylisobutyl carbinol, and alkali or alkaline earth metal carboxylate soaps are typical frothing agents. Frothing agents are heteropolar organic compounds which reduce surface tension by being absorbed at air-water interfaces and thus facilitate formation of bubbles and froth. Two such commercially available frothing agents are "Dowfroth" produced by the Dow Chemical Company and methylisobutyl carbinol (MIBC). Various combinations of these materials often are used as frothing agents.

Following the addition of the frothing agents, the slurry is agitated with air to form a froth which is collected until depleted. The desired copper minerals are recovered from the froth. Alternatively the collected rougher froth may be subjected to one or more cleaning stages using 35° C. tap water is required prior to recovery of the copper from the froth.

The effectiveness of the promoter collectors of the invention for ores containing copper as atacamite/-paratacamite is demonstrated in the following examples carried out on the ores obtained from Arizona identified in Table I. Unless otherwise indicated, all parts and percentages are by weight. Weights reported as lb/T indicate weight of reagent in pounds per ton of crude ore.

EXAMPLE 1

The ore identified as ore No. 1 in Table I wherein approximately 80% of the copper occurs as atacamite/-paratacamite is ground in a steel mill with forged steel balls and tap water at about 65% solids to a powder of about 97% −100 mesh. The slurry is filtered, transferred to a Fagegren flotation cell and repulped with tap water at about 35° C. In this example, the pH of the slurry is adjusted with a base in several different samples to values ranging from 6 to 11 to demonstrate the influence of pH on the recovery of copper. The dimethyl ammonium salt of an alkyl hydroxamate wherein the alkyl group comprises an approximately equal mixture of $C_7$ and $C_9$, is added at a level of 0.40 lb/T, and the slurry is conditioned for twenty minutes. After conditioning, a small amount of a frothing agent comprising a 1:1 ratio of pine oil and methylisobutyl carbinol (MIBC) is added as required. Air is admitted into the slurry gradually to develop a froth which is collected in a pan. When the addition of frothing agent no longer produces froth, the air is turned off and the combined forth is collected.

The atacamite/paratacamite content of the rougher combined froth is determined by analyzing for chlorine. The rougher froth then is subjected to two cleaning stages using 35° C. tap water as required. The atacamite/paratacamite content of the cleaner froth also is determined by analysis for chlorine. In this ore nearly all of the chlorine occurs in the minerals atacamite/-paratacamite. The results of these tests, summarized in the drawing indicate that the initial rougher flotation chlorine recovery does not vary much in the slurry pH range of from about 6.0 to 10.0 but drops at a pH above 10. The optimum chlorine recovery in the cleaner circuit is obtained at pH 8.0 to 8.5.

EXAMPLE 2

The procedure of Example 1 is repeated except that the ore is the ore identified as ore No. 2 in Table I, the pH of the slurry is adjusted to about 9.7 prior to adding the promoter collector at a level of 1.13 lb/T. The results of this example (no cleaning stages) are summarized in Table II.

TABLE II

| | | Assay % | | | | % Distribution | | | |
|---|---|---|---|---|---|---|---|---|---|
| Product | % Wt. | Total Cu | Ox Cu | S Cu | Cl | Total Cu | Ox Cu | S Cu | Cl |
| Concentrate | 28.82 | 4.37 | 3.13 | 1.24 | 0.67 | 80.74 | 75.83 | 96.53 | 96.44 |
| Tailing | 71.18 | 0.422 | 0.404 | 0.018 | 0.01 | 19.26 | 24.17 | 3.47 | 3.56 |
| Calc Head | 100.00 | 1.56 | 1.19 | 0.37 | 0.20 | 100.00 | 100.00 | 100.00 | 100.00 |

The experiments which have been carried out indicate that compounds of the type represented by Formula I perform satisfactorily as promoter collector agents in flotation processes for extracting copper from ores containing copper as atacamite/paratacamite.

The embodiments of the invention in which an exclusive property or privilege is claimed are defined as follows:

1. In the method of recovering copper from ores containing copper as atacamite/paratacamite by froth flotation of the copper, the improvement comprising using as a promoter collector, compounds having the formula $$RC(OH)=N-O^{\ominus}H_2N^{\oplus}R^1R^2$$

wherein R is an aliphatic group containing from about five to ten carbon atoms or an aromatic group containing from six to about ten carbon atoms, and $R^1$ and $R^2$ are each independently alkyl groups containing from one to about five carbon atoms.

2. The method of claim 1 wherein R is an aliphatic group containing from about five to ten carbon atoms.

3. The method of claim 2 wherein $R^1$ and $R^2$ are methyl groups.

4. The method of claim 1 wherein R contains about eight carbon atoms.

5. A method of recovering copper from ores containing copper as atacamite/paratacamite by flotation which comprises (a) preparing a slurry of the ore in water, (b) adjusting the pH of the slurry to between about 6 and 10, (c) adding to the slurry a compound having the formula $$RC(OH)=N-O^{\ominus}H_2N^{\oplus}R^1R^2$$

wherein R is an aliphatic group containing from about five to ten carbon atoms or an aromatic group containing from six to about ten carbon atoms, and $R^1$ and $R^2$ are each independently alkyl groups containing from one to five carbon atoms.

(d) adding a frothing agent to the slurry, (e) agitating the slurry to form a froth containing the floated copper, (f) removing the froth, and (g) recovering the floated copper from the froth.

6. The method of claim 5 wherein the pH of the slurry in step (b) is adjusted to between about 8 and 9.

7. The method of claim 5 wherein R is an aliphatic group containing from five to ten carbon atoms.

8. The method of claim 5 wherein $R^1$ and $R^2$ are methyl groups.

9. The method of claim 5 wherein R contains about eight carbon atoms.

10. The method of claim 5 wherein up to about 3.6 lbs. of the compound is added in step (c) per ton of ore.

11. The method of claim 5 wherein the frothing agent is a pine oil, cresylic acid, an alcohol or an alkali or alkaline earth metal carboxylate soap.

* * * * *